US005302020A

United States Patent [19]

Kruse

[11] Patent Number: 5,302,020

[45] Date of Patent: Apr. 12, 1994

[54] PLANETARY MIXING APPARATUS

[75] Inventor: Ernst O. Kruse, Gottmadingen, Fed. Rep. of Germany

[73] Assignee: Georg Fischer AG, Schaffhausen, Switzerland

[21] Appl. No.: 40,868

[22] Filed: Mar. 31, 1993

[30] Foreign Application Priority Data

Apr. 15, 1992 [CH] Switzerland ..... 1-254/92

[51] Int. Cl.[5] ..... B01F 7/30

[52] U.S. Cl. ..... 366/288

[58] Field of Search ..... 366/64–66, 366/192, 287, 288, 297–300, 347

[56] References Cited

U.S. PATENT DOCUMENTS

| | | | |
|---|---|---|---|
| 1,847,227 | 3/1932 | Ringwald | 366/288 |
| 3,075,746 | 1/1963 | Yablonski et al. | 366/288 |
| 4,380,398 | 4/1983 | Burgess | 366/288 x |
| 4,697,929 | 10/1987 | Muller | 366/288 X |
| 4,704,035 | 11/1987 | Kowalczyk | 366/288 X |
| 4,786,184 | 11/1988 | Berezkina et al. | 366/288 |
| 5,028,141 | 7/1991 | Stiegelmann | 366/288 X |

FOREIGN PATENT DOCUMENTS

| | | | |
|---|---|---|---|
| 3312869 | 11/1984 | Fed. Rep. of Germany . | |
| 975014 | 10/1950 | France | 366/288 |
| 1430089 | 10/1988 | U.S.S.R. | 366/287 |
| 1629080 | 2/1991 | U.S.S.R. | 366/288 |

*Primary Examiner*—Harvey C. Hornsby
*Assistant Examiner*—Charles Cooley
*Attorney, Agent, or Firm*—Bachman & LaPointe

[57] ABSTRACT

A mixing vessel with a rotatable drive member for driving a mixer through a coupling mechanism such that the mixer orbits or revolves about a first axis (A) while at the same time rotates about a second axis (B) disposed radially of and substantially parallel to said first axis (A). The mixer rotates about axis (B) at a rotational speed of between 200 to 1,000 rpm while orbiting about axis (A) at a rotational sped of between 20 to 200 rpm. A second mixer in the form of a mixer plow is fixed to the rotatable drive member for rotation about axis (A).

3 Claims, 1 Drawing Sheet

PLANETARY MIXING APPARATUS

BACKGROUND OF THE INVENTION present invention relates to an apparatus for

The mixing and preparing fluid materials, in particular mold sand, with a cylindrical mixing vessel.

Mixers are known in which centrifugal shafts and mixing arms are provided; however, the shafts and mixing arms do not revolve but are fixedly arranged. In these known mixers, in order to feed the material to be mixed to the mixing tools either the mixer base is set in rotation, which entails considerable problems in sealing the rotating mixer base against the stationary mixer wall, or the entire mixer vessel is set in rotation with a fixed arrangement of the mixing tools. See for example DE-A-33 12 869 Al. Both these arrangements require a complicated and fault-prone construction as far as the discharge door and the sealing of the mixing upper part with respect to the rotating mixing vessel are concerned.

It is the principle object of the present invention to avoid the above disadvantages and provide a mixer which is simple in construction, inexpensive to produce and presents no problems in operation.

Further objects and advantages will appear hereinbelow.

SUMMARY OF THE INVENTION

The foregoing object is achieved by way of the present invention wherein a mixing vessel with a rotatable drive member for driving a mixer through a coupling mechanism such that the mixer orbits or revolves about a first axis (A) while at the same time rotates about a second axis (B) disposed radially of and substantially parallel to said first axis (A). In accordance with a particular feature of the present invention, the mixer rotates about axis (B) at a rotational speed of between 200 to 1,000 rpm while orbiting about axis (A) at a rotational speed of between 20 to 200 rpm. In accordance with a further feature of the present invention a second mixer in the form of a mixer plow is fixed to the rotatable drive member for rotation about axis (A).

DETAILED DESCRIPTION

Figure 1:
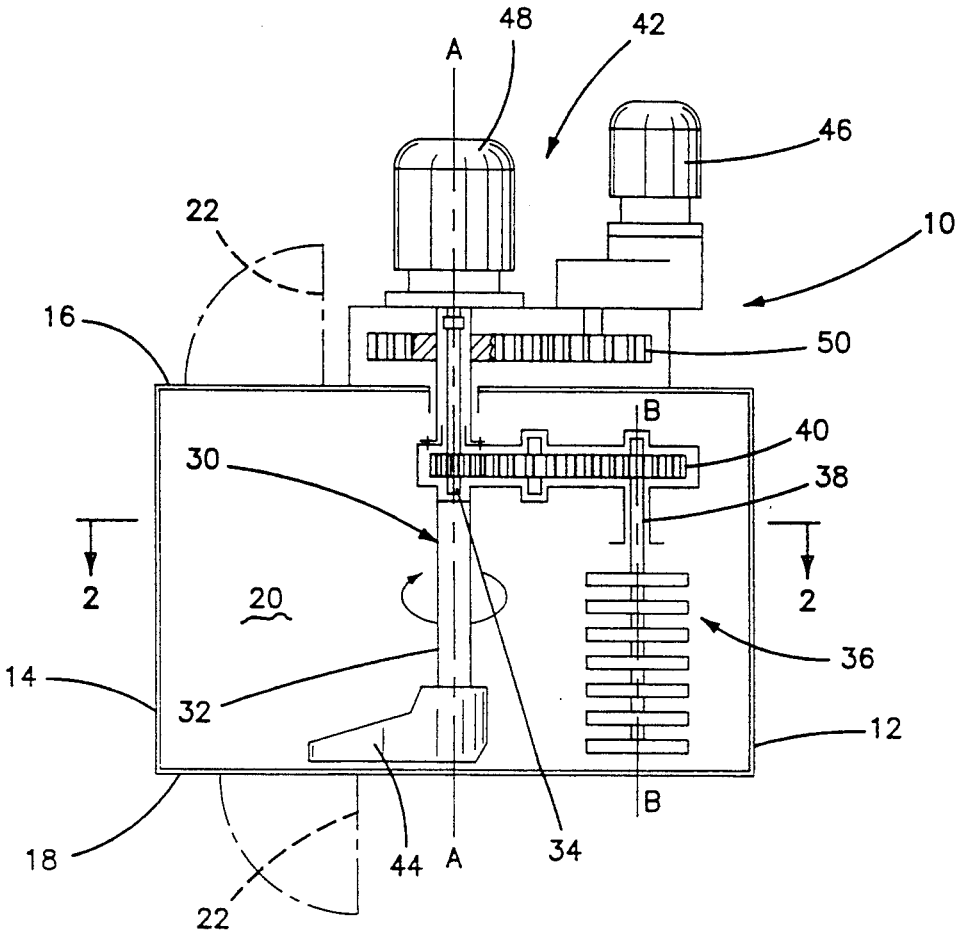
FIG. 1 is a schematic, partial cross-sectional view of a mixing device in accordance with the present invention.

With reverence to FIGS. 1 and 2 the apparatus of the present invention will be discussed in detail.

The mixing device 10 comprises a mixing vessel 12 having a substantially cylindrical sidewall 14 which extends about a central axis (A). The vessel 12 further includes a top cover 16 and a bottom base 18 which define with sidewall 14 a mixing chamber 20. Cover 16 and base 18 may be provided with access doors 22 for feeding and removing molding sand to the mixing vessel 12.

Drive means 30 is rotatably mounted in mixing chamber 20 about axis (A) and comprises first and second concentric 10 drive shafts, 32 and 34, respectively. A first mixer 36 is located radially of the drive means 30 and extends on centrifugal shaft 38 about axis (B) which lies substantially parallel to axis (A). Centrifugal shaft

38 is coupled to the second drive shaft 34 by a gear coupling 40, shown schematically, for rotating the mixer 36 about axis (B). The mixer 36 is also fixed to the first drive shaft 32 such that the mixer orbits (revolves) about axis (A) when drive shaft 32 is rotated by motor means 42 described below. A mixing plow 44 is connected to drive shaft 32 for rotation therewith about axis (A).

Figure 2:
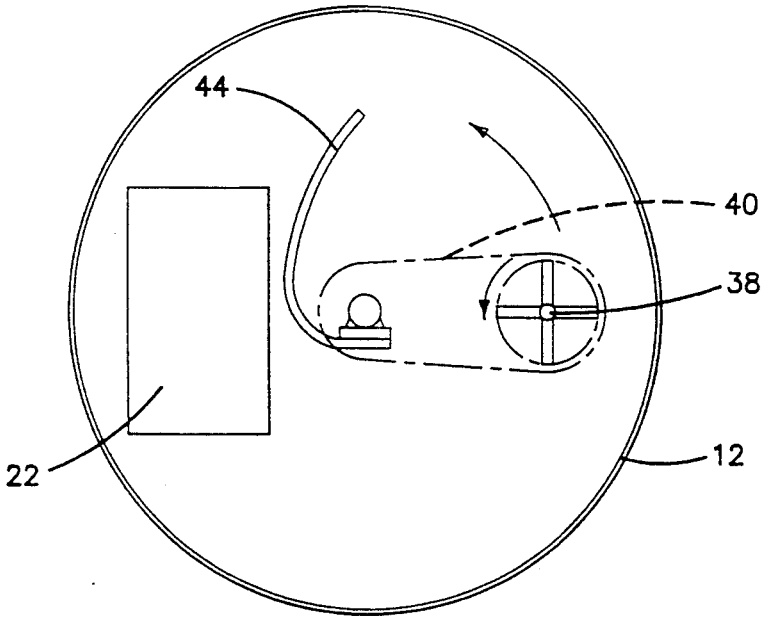
FIG. 2 is a top sectional view of the device of FIG. 1 take along line 2—2.

As schematically shown in FIGS. 1 and 2, the drive means 42 comprises first and second drive motor 46 and 48, respectively. Motor 46 is coupled to first drive shaft 32 by coupling means, preferably a gear coupling, shown schematically at 50. Motor 48 is connected to second drive shaft 34 for driving centrifugal shaft 38 via coupling 40. It should be appreciated that a single motor may be employed with suitable coupling as the drive means 42.

The operation of the device of the present invention will now be described. Motor 48 drives shaft 34 which drives shaft 38 via coupling 40 for rotating the mixer 36 about axis (B). At the same time motor 46 drives shaft 32 via coupling 50 for orbiting mixer 36 about axis (A). Thus, mixer 36 orbits while rotating for effectively mixing the molding sand as shown in FIG. 2. In addition, mixing plow 44 connected to drive shaft 32 rotates about axis (A) while mixer 36 orbits about axis (A). In accordance with the present invention, mixer 36 rotates at a rotational speed of between 200 to 1,000 rpm while orbiting at a rotational speed of between 20 to 200 rpm.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for mixing molding sand so as to prepare a fluid molding sand mixture comprises:

a mixing vessel having an elongated sidewall portion extending about an axis (A), a top cover and a bottom base which together define a mixing chamber;

drive means disposed about said axis (A) within said mixing chamber;

first mixing means located radially of said drive means about an axis (B) substantially parallel to said axis (A);

coupling means located between said drive means and said first mixing means for drivingly connecting said drive means to said first fixing means;

motor means for driving said drive means for orbiting said first mixing means about axis (A) as said first mixing means rotates about axis (B);

said drive means includes a first drive shaft connected to said coupling means for orbiting said first mixing means about axis (A) and a second drive shaft concentric with said first drive shaft and connected to said coupling means for rotating said first mixing means about axis (B);

second mixing means fixed to said first drive shaft wherein said second mixing means rotates about axis (A) as said first mixing means orbits about axis (A); and said coupling means includes a first gear unit positioned between said motor means and said first drive shaft and a second gear unit positioned between said second drive shaft and a centrifugal shaft of said first mixing means for rotating said first mixing means about axis (B).

2. An apparatus according to claim 1 wherein said motor means includes a first motor connected to said first drive shaft by said first gear unit and a second motor connected to said second drive shaft.

3. An apparatus according to claim 1 wherein said drive means rotates said first mixing means about axis (B) at a rotational speed of about 200 to 1,000 rpm and orbits said first mixing means about axis (A) at a rotational speed of about 20 to 200 rpm.

* * * * *